US009133424B2

(12) United States Patent
Smith et al.

(10) Patent No.: US 9,133,424 B2
(45) Date of Patent: Sep. 15, 2015

(54) STABILIZATION AND ACTIVATION OF PROTEASE FOR USE AT HIGH TEMPERATURE

(75) Inventors: Kim R. Smith, Woodbury, MN (US); Thomas R. Mohs, Eagan, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 13/327,810

(22) Filed: Dec. 16, 2011

(65) Prior Publication Data

US 2013/0157345 A1 Jun. 20, 2013

(51) Int. Cl.

| | |
|---|---|
| ***D06L 1/16*** | (2006.01) |
| ***B08B 3/08*** | (2006.01) |
| ***C11D 3/386*** | (2006.01) |

(52) U.S. Cl.

CPC ..... *C11D 3/38663* (2013.01); *C11D 3/386* (2013.01); *D06L 1/16* (2013.01)

(58) Field of Classification Search

CPC .. C11D 3/386; C11D 3/38663; C11D 3/3937; C11D 3/394; B08B 3/08; D06L 1/16

See application file for complete search history.

(56) References Cited

U.S. PATENT DOCUMENTS

| | | | | |
|---|---|---|---|---|
| 3,079,263 | A * | 2/1963 | Foster, Jr. et al. | 426/39 |
| 4,238,345 | A | 12/1980 | Guilbert | |
| 4,243,543 | A | 1/1981 | Guilbert | |
| 4,243,546 | A | 1/1981 | Shaer | |
| 4,318,818 | A * | 3/1982 | Letton et al. | 510/393 |
| 4,529,525 | A | 7/1985 | Dormal et al. | |
| 4,771,003 | A * | 9/1988 | Stellwag et al. | 435/221 |
| 5,078,898 | A | 1/1992 | Jars | |
| 5,281,277 | A | 1/1994 | Nakagawa et al. | |
| 5,792,736 | A | 8/1998 | Nakayama et al. | |
| 5,948,745 | A * | 9/1999 | Cao et al. | 510/321 |
| 6,191,092 | B1 * | 2/2001 | Bragulla et al. | 510/392 |
| 6,420,332 | B1 | 7/2002 | Simpson | |
| 6,569,827 | B2 | 5/2003 | Van Dijk et al. | |
| 2005/0049166 | A1 | 3/2005 | Huang | |
| 2005/0266542 | A1 | 12/2005 | Baur et al. | |
| 2009/0192064 | A1 | 7/2009 | Geret et al. | |
| 2011/0174340 | A1 | 7/2011 | Choczaj et al. | |

FOREIGN PATENT DOCUMENTS

| | | | |
|---|---|---|---|
| DE | 102009006594 | A1 | 8/2010 |
| EP | 0451924 | B1 | 10/1991 |
| GB | 1191074 | B2 * | 5/1970 |
| JP | 11209795 | | 8/1999 |
| JP | 2008031243 | A * | 2/2008 |
| JP | 2011174054 | A | 9/2011 |

OTHER PUBLICATIONS

Helen S. Toogood, Clyde A. Smith, Edward N. Baker. and Roy M. Daniel, Purification and characterization of Ak.1 protease, a thermostable subtilisin with a disulphide bond in the substrate-binding cleft, 2000, Biochem. J., vol. 350, pp. 321-328.*

Keith Peek, Dallas P. Veitch, Mark Prescott, Roy M. Daniel, Bryce MacIver, and Peter L. Bergquist, Some Characteristics of a Proteinase from a *Thermophilic bacillus* sp. Expressed in *Escherichia coli*: Comparison with the Native Enzyme and Its Processing in *E. coli* and In Vitro, 1993, Applied and Environmental Microbiology, vol. 59, No. 4, p. 1168-11.*

Dessislava Nikolova Georgieva, Stanka Stoeva, Wolfgang Voelter et al., Differences in the Specificities of the Highly Alkalophilic Proteinases Savinase and Esperase Imposed by Changes in the Rigidity and Geometry of the Substrate Binding Sites, 2001, Archives of Biochemistry and Biophysics, vol. 387. No. 2. Mar. 15, pp. 197-201.*

Durham, Stewart, and Stellwag, Novel Alkaline- and Heat-Stable Serine Proteases from *Alkalophilic bacillus* sp. Strain GX6638, 1987, Journal of Bacteriology, vol. 169, No. 6, pp. 2762-2768.*

Murachi, Bromelain Enzymes, 1970, Methods in Enzymology, pp. 273-284.*

NPL pdf document "cocoamidyl propyl butane" accessed from http://www.commonchemistry.org/NoResults.aspx?terms=cocoamidyl+propyl+butane on Feb. 7, 2014.*

NPL pdf document "Cocamidopropyl betaine" accessed from http://en.wikipedia.org/wiki/Cocamidopropyl_betaine on Feb. 7, 2014.*

M E Pettitt, S L Henry, M E Callow, J A Callow and A S Clare, Activity of Commercial Enzymes on Settlement and Adhesion of Cypris Larvae of the Barnacle Balanus amphitrite, Spores of the Green Alga Ulva linza, and the Diatom Navicula perminuta, 2004, Biofouling, December, vol. 20 (6), pp. 299-311.*

"Miele washer" pdf of screenprint of http://washing-machines.findthebest.com/I/151/Miele-W3033 accessed Aug. 19, 2014.*

JP 2008-031243, Ono et al., published Feb. 14, 2008, English machine translation provided by JPO.* pdf "Softazoline LBP" of webpage from http://www.kawakenfc.co.jp/sys/products/view/140 accessed Aug. 22, 2014.* pdf "Cocamidopropyl betaine" of webpage http://en.wikipedia.org/wiki/Cocamidopropyl_betaine accessed Aug. 22, 2014.*

Moradian, Fatemeh, et al., "Isolation, Purification and Characterization of a Surfactants-, Laundry Detergents- and Organic Solvents-Resistant Alkaline Protease from *Bacillus* sp. HR-08", Humana Press, Published on Jan. 16, 2009, Appl. Biochem. Biotechnol (2009) 159:33-45 (13 pages).

English Abstract of JP 11-209795, published on Aug. 3, 1999 (1 page).

English Abstract of DE 102009006594 Al, published on Aug. 5, 2010 (1 page).

JP2011174054, Sanyo Chemical Industries—English Abstract.

Ecolab USA Inc., filed Dec. 13, 2012, "The International Search Report and the Written Opinion of the International Searching Authority, or the Declaration", mail date Mar. 28, 2013.

* cited by examiner

*Primary Examiner* — Ralph Gitomer
*Assistant Examiner* — Trent Clarke
(74) *Attorney, Agent, or Firm* — McKee, Voorhees & Sease, PLC

(57) ABSTRACT

Methods for use of select organic compounds for the activation and stabilization of thermally labile enzymes, including proteases, are disclosed. The invention further relates to compositions of certain organic compounds with enzymes to enable the use of such enzymes at high temperature conditions, such as for warewash temperatures and conditions. In particular, organic activator-stabilizers including heat-deactivated proteases and zwitterionic materials are combined with enzymes according to the invention. As a result, the invention provides enzyme cleaning efficacy for various high temperature conditions, including warewash applications.

11 Claims, No Drawings

STABILIZATION AND ACTIVATION OF PROTEASE FOR USE AT HIGH TEMPERATURE

FIELD OF THE INVENTION

The invention relates to use of enzymes at high temperature conditions, such as ware wash temperatures and conditions in excess of at least 160° F. In particular, the invention relates to use of protease enzymes for effectively removing soils in warewash applications. The invention prevents the inactivation and degradation of enzymes, including proteases, under high temperature conditions as a result of combination of the enzyme with a stabilizer/activator component. The methods and compositions according to the invention provide select organic compounds for the activation and stabilization of thermally labile enzymes, including proteases. The invention uses select organic compounds, including for example the following organic activator-stabilizers: heat-deactivated proteases and zwitterionic materials, such as amphoteric surfactants and amino acids and proteins.

BACKGROUND OF THE INVENTION

Enzymes are a group of proteins that catalyze a variety of typical biochemical reactions and have been employed in cleaning compositions since early in the 20$^{th}$ century. It was not until the mid 1960's when enzymes were commercially available with both the pH stability and soil reactivity for detergent applications. Enzymes are known as effective chemicals for use with detergents and other cleaning agents to break down soils. Enzymes break down soils making them more soluble and enabling surfactants to remove them from a surface and provided enhanced cleaning of a substrate.

Enzymes can provide desirable activity for removal of protein-based, carbohydrate-based, or triglyceride-based stains from substrates. As a result, enzymes have been used for various cleaning applications in order to digest or degrade soils such as grease, oils (e.g., vegetable oils or animal fat), protein, carbohydrate, or the like. For example, enzymes may be added as a component of a composition for laundry, textiles, cleaning-in-place, drains, floors, carpets, medical or dental instruments, meat cutting tools, hard surfaces, personal care, or the like. The use of enzyme products have evolved from simple powders containing alkaline protease to more complex granular compositions containing multiple enzymes and still further to liquid compositions containing enzymes. In addition, significant progress has been made to obtain enzymes retaining stability under alkaline conditions, such as the presence of detergent builders and other detergent compositions. See e.g. U.S. Pat. Nos. 4,771,003, 4,529,525, 4,480,037 and 4,052,262, each of which are herein incorporated by reference in its entirety. Despite such advances there remains a lack of consistent stability under highly concentrated conditions for enzyme and detergent formulations and/or long-term storage of shelf stability.

In addition, there remains a need for cleaning applications using enzymes under high temperature conditions. Most proteases and other enzymes are unable to survive at elevated temperatures, typically unable to survive temperatures above about 140° F. to about 150° F. Upon exposure to such elevated temperatures, the enzyme is denatured or damaged, such that there is a change in the configuration of the structure (although not limited to a particular theory as one skilled in the art shall ascertain) and as a result the enzymes are unable to be used in numerous desirable cleaning applications. Enzyme instability due to decomposition caused by either denaturation or by proteolysis (self-digestion) are well established limitations to the use of enzymes in cleaning compositions. Methods for stabilizing enzymes over extended periods of time and for exposure to heat, causing reduced enzyme stability, remain as current limitations of enzymes.

Accordingly, it is an objective of the invention to develop methods to permit the use of enzymes to remove soils under high temperature conditions, such as ware wash applications.

A further object of the invention is to develop methods for stabilizing and activating thermally labile enzymes.

A still further object of the invention is to develop compositions for the stabilization and activation of thermally labile enzymes for use in high temperature conditions, including for example warewash applications.

BRIEF SUMMARY OF THE INVENTION

An embodiment of the invention includes a method of cleaning a hard surface comprising: contacting the hard surface with an aqueous use solution composition comprising from about 0.1 ppm to about 10,000 ppm enzymes, from about 0.1 ppm to about 10,000 ppm organic activator-stabilizers, and wherein said organic activator-stabilizers prevent the deactivation of said enzymes at temperatures in excess of at least 150° F.

According to the invention, the methods include the use of a protease enzyme and an organic activator-stabilizer that is a heat deactivated enzyme. The invention further embodies the use of organic activator-stabilizers selected from the group consisting of heat-deactivated enzymes, denatured enzymes, zwitterionic materials and combinations of the same, wherein the zwitterionic materials are members of the group consisting of amphoteric surfactants, amino acids, proteins and combinations of the same.

According to additional embodiments of the invention, the protease enzyme in an aqueous use solution is between about 1 ppm and about 400 ppm, and the heat deactivated enzyme in said aqueous use solution is between about 1 ppm and 400 ppm. Further embodiments of the invention may include the adfixing of a multi-use solid concentrated composition capable of forming the aqueous use solution to the inside of a cleaning application (e.g. dishwash or wash apparatus) and contacting a water source to generate the use solution. Still further, the invention may include the addition of a single use concentrated liquid or solid composition capable of forming said aqueous use solution to a water source to form the aqueous use solution.

An additional embodiment of the invention includes a method of cleaning a hard surface comprising: forming an organic activator-stabilizer; contacting the hard surface with sufficient organic activator-stabilizer to form an aqueous use solution of from about 0.1 ppm to about 10,000 ppm organic activator-stabilizer; and contacting the hard surface with sufficient enzyme to generate from about 0.1 ppm to about 10,000 ppm enzymes in the aqueous use solution, wherein said organic activator-stabilizer prevents the deactivation of said enzymes at temperatures in excess of at least 150° F. The methods may further include use of a detergent composition, wherein the detergency is not compromised by the enzymes and/or an organic activator-stabilizer. Preferably, the enzyme is a protease and the organic activator-stabilizer is a heat deactivated enzyme.

According to an additional embodiment of the invention, the step of forming the organic activator-stabilizer may include exposing an enzyme to sufficient heat to deactivate or denature said enzyme to generate said organic activator-stabilizer. The step of forming the organic activator-stabilizer may be integrated into a cleaning application, such as adding a first enzyme source to a cleaning application involving a water source at a temperature in excess of about 140° F. to denature the enzyme and form the organic activator-stabilizer.

A still further embodiment of the invention includes an enzyme stabilizing and activating aqueous use solution for use at elevated temperatures comprising: from about 0.1 ppm to about 10,000 ppm enzymes; and from about 0.1 ppm to about 10,000 ppm organic activator-stabilizers selected from the group consisting of heat-deactivated enzymes, denatured enzymes, zwitterionic materials and combinations of the same, and wherein said organic activator-stabilizers prevent the deactivation of said enzymes at temperatures in excess of at least 150° F. According to particular embodiments of the invention, the enzyme is a protease and the organic activator-stabilizer is a heat deactivated enzyme.

The particular enzyme or combination of enzymes for use in the methods and compositions of the invention depend upon the conditions of final utility, including the physical product form, use pH, use temperature, and soil types to be cleaned in a particular cleaning application. The enzyme or combination of enzymes are selected to provide optimum activity and stability for a given set of utility conditions as one skilled in the art will recognize based on the disclosure of the claimed invention. In addition, the particular organic activator-stabilizers will depend upon the selection of the particular enzyme or combination of enzymes for use as disclosed herein according to the various embodiments of the invention.

DETAILED DESCRIPTION OF THE PREFERRED EMBODIMENT

The embodiments of this invention are not limited to particular methods of cleaning using traditionally heat labile enzymes, removing soils under high temperature conditions with the use of traditionally heat labile enzymes and/or compositions for achieving the same beneficial results, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities refers to variation in the numerical quantity that can occur.

The term "detersive enzyme," as used herein, refers to any enzyme having a cleaning, stain removing or otherwise beneficial effect in cleaning applications, including for example warewash applications. Enzymes as referred to herein can be included in the present compositions and methods of use thereof for a variety of purposes, including for example, removal of protein-based, carbohydrate-based or triglyceride-based stains or combinations thereof. As disclosed herein, suitable detersive enzymes (or simply "enzymes" as may also be used herein to describe embodiments of the invention), proteases, amylases, lipases, cellulases, peroxidases and the like and mixtures thereof. The enzymes may be of any suitable origin, for example bacterial or fungal enzymes.

As used herein, the term "ware" refers to items such as eating and cooking utensils, dishes, and other hard surfaces such as showers, sinks, toilets, bathtubs, countertops, windows, mirrors, transportation vehicles, and floors. As used herein, the term "warewashing" refers to washing, cleaning, or rinsing ware. Ware also refers to items made of plastic. Types of plastics that can be cleaned with the compositions according to the invention include but are not limited to, those that include polycarbonate polymers (PC), acrilonitrile-butadiene-styrene polymers (ABS), and polysulfone polymers (PS). Another exemplary plastic that can be cleaned using the compounds and compositions of the invention include polyethylene terephthalate (PET).

The term "wash water," "wash water source," "wash water solution," and the like, as used herein, refer to water sources provided to a cleaning application. Wash water or the like, according to the invention, is not limited according to the source of water. Exemplary water sources suitable for use as a wash water source include, but are not limited to, water from a municipal water source, or private water system, e.g., a public water supply or a well, or any water source. Preferably wash water contains some hardness ions.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The compositions and methods described herein according to the invention provide the benefit of use of thermally labile enzymes at high temperature conditions with the use of a stabilizer/activated. This presents a significant advantage over prior art cleaning applications having the temperature limitations precluding the use of thermally labile enzymes, such as proteases. In particular, the invention relates to use of enzymes at high temperature conditions, such as for ware wash temperatures and conditions in excess of about 160° F. According to preferred embodiments, the invention relates to use of protease enzymes for effectively removing soils in warewash applications. The invention prevents the inactivation and degradation of enzymes, including proteases, under high temperature conditions. The methods and compositions according to the invention provide select organic compounds for the activation and stabilization of thermally labile enzymes, including proteases.

Stabilization and activation of enzymes according to the invention allows the use of thermally labile enzymes at temperatures exceeding those suitable for use according to standard temperature limitations, including for example temperatures above at least 150° F./65° C., preferably above at least about 160° F./71° C., and more preferably above at least between about 160-170° F./71-77° C. This overcomes a significant limitation of the use of the heat labile enzymes having prior limitations of use above temperatures of approximately 140° F./60° C. In addition to the stabilization of enzymes at high temperatures according to the invention, certain embodiments of the invention further activate the enzymes at the same high temperatures. As a result of the stabilization and/or activation according to the invention and without being limited to a particular theory of the mechanism of action of the stabilization and/or activation, enzymes are suitable for use at high temperature ranges. According to a preferred embodiment, the compositions and methods of use of the invention maintain and/or exceed performance of the enzymes at temperatures about at least 150° F., preferably above at least 160° F., and more preferably above at least between 160-170° F.

Compositions

The compositions according to the invention may comprise, consist of and/or consist essentially of at least one enzyme and at least one organic activator-stabilizer. According to further embodiments of the invention, the compositions may further comprise, consist of and/or consist essentially of a detergent and/or additional functional agents.

Enzymes

Various enzymes can be used for the compositions according to the invention to break down adherent soils, such as starch or proteinaceous materials, typically found in soiled surfaces and typically treated with detergent compositions. Various enzymes for use according to the invention to decrease and/or eliminate the soils on a treated substrate may be utilized in combination with the organic activator-stabilizer compounds.

Exemplary types of enzymes which can be incorporated into the compositions according to the invention include protease, amylase, lipase, esterase, cellulase, cutinase, gluconase, peroxidase and/or mixtures thereof. The compositions according to the invention may employ more than one enzyme, from any suitable origin, such as vegetable, animal, bacterial, fungal or yeast origin. According to an embodiment of the invention, the composition includes at least one enzyme. According to a further embodiment of the invention, the composition includes at least two enzymes. According to a still further embodiment of the invention, mixtures of the same class of enzymes are incorporated into the compositions, such as a mixture of various protease enzymes.

Examples of commercially-available protease enzymes are available under the following trade names: Savinase, Esperase, Purafect, Purafect L, Purafect Ox, Everlase, Liquanase, Prime L, Prosperase and Blap. Examples of commercially-available amylase enzymes are available under the following trade names: Purastar, Purastar ST, HP AmL, Maxamyl, Duramyl, Termamyl and Stainzyme. Lipases are commercially available, for example, under the trade name Lipex and Lipolase. Cellulase enzymes are commercially-available, for example, under the trade name Celluzyme.

According to the invention, the enzyme(s) selected for a particular composition may be varied based on the particular cleaning application and the types of soils in need of cleaning According to the invention, the temperature of a particular cleaning application is no longer a limiting factor for the selection of enzymes as a result of the combination of the enzyme with the select organic activator-stabilizer compounds. According to a preferred embodiment of the invention, for ware wash applications which require temperatures in excess of about 150° F. proteases are desirable.

According to the invention, the active level of enzyme in the aqueous use solution may be modified according to the precise requirements of the cleaning application. For example, the amount of enzyme formulated into the enzyme composition may vary. Alternatively, as one skilled in the art will appreciate, the active level of the aqueous use solution may be adjusted to a desired level through control of the wash time, water temperature at which the water source contacts the enzyme composition or the enzyme and detergent composition in order to form the aqueous use solution and the detergent selection and concentration.

The amounts of enzymes according to the invention constitute a cleaning-effective amount, and refer to any amount capable of producing a cleaning, stain removal, soil removal, whitening, deodorizing or freshness improving effect on substrates, including for example warewash. According to a preferred embodiment, an aqueous use solution according to the invention may comprise, consist of and/or consist essentially of approximately 0.1 ppm and 10,000 ppm enzyme, preferably between about 0.5 ppm and about 800 ppm, and more preferably between approximately 1 ppm and 400 ppm enzyme.

According to further embodiments of the invention, the amount of enzyme needed to clean and remove soils from a particular cleaning application varies according to the type of cleaning application and the soils encountered in such applications. According to various embodiments of the invention, levels of enzymes in an aqueous use solution are effective at or below approximately 0.1 ppm, 0.5 ppm or 1 ppm. According to alternative embodiments, use levels of enzymes may be as great as 10,000 ppm, with most applications utilizing enzymes in aqueous use solutions between approximately 1-400 ppm.

In addition to variations in the concentration of enzymes in compositions according to the invention, as one skilled in the art shall ascertain, enzymes are further selected based upon the ability to clean specific types of soils. A variety of detersive enzymes can be used according to the invention. For example, according to an embodiment of the invention, ware wash applications may use an amylase enzyme as it is in reducing starchy, carbohydrate-based soils. Although not limiting the present invention, it is believed that amylase can be advantageous for cleaning soils containing starch. Amylase enzymes can be obtained from any suitable source, such as bacterial strains, barley malt, certain animal glandular tissues and any others known to the art. Amylase enzymes may include those which are referred to as alpha-amylases, beta-amylases, iso-amylases, pullulanases, maltogenic amylases, amyloglucosidases, and glucoamylases, as well as other amylases enzymes not particularly identified herein. These also include endo- and exo-active amylases.

According to an alternative embodiment, methods of cleaning ware applications may further use a protease to reduce starch, protein and oil soils. According to an additional alternative embodiment of the invention, a combination of amylase and protease enzymes may be used for cleaning applications employing a detergent in order to most effectively prevent starch, proteins and oils from hindering detergent performance. Although not limiting the present invention, it is believed that protease can be advantageous for cleaning soils containing protein, such as blood, cutaneous scales, mucus, grass, food (e.g., egg, milk, spinach, meat residue, tomato sauce), or the like. Protease enzymes are capable of cleaving macromolecular protein links of amino acid residues and convert substrates into small fragments that are readily dissolved or dispersed into a wash water source. Proteases are often referred to as detersive enzymes due to the ability to break soils through the chemical reaction known as hydrolysis. Protease enzymes can be obtained, for example, from *Bacillus subtilis, Bacillus licheniformis* and *Streptomyces griseus*. Protease enzymes are also commercially available as serine endoproteases.

According to an additional embodiment of the invention, a cellulose or lipase enzyme may be incorporated into a composition. Although not limiting the present invention, it is believed that cellulase can be advantageous for cleaning soils containing cellulose or containing cellulose fibers that serve as attachment points for other soil. Although not limiting to the present invention, it is believed that lipase enzymes can be advantageous for cleaning soils containing fat, oil, or wax, such as animal or vegetable fat, oil, or wax (e.g., salad dressing, butter, lard, chocolate, lipstick). Both cellulase and lipase enzymes can be derived from a plant, an animal, or a microorganism, such as a fungus or a bacterium. A cellulase or lipase enzyme can be purified or a component of an extract, and either wild type or variant (either chemical or recombinant).

Additional enzymes suitable for certain embodiments of the invention include cutinase, peroxidase, gluconase, and the like. Suitable enzymes are described for example in WO 8809367 (cutinase), WO 89099813 and WO 8909813 (peroxidases), and WO 9307263 and WO 9307260 (gluconase). Known peroxidase enzymes include horseradish peroxidase, ligninase, and haloperoxidases such as chloro- or bromoperoxidase. Peroxidase enzymes can be used in combination with oxygen sources, e.g., percarbonate, perborate, hydrogen peroxide, and the like. Each of these enzymes may be derived from a plant, an animal, or a microorganism and can be purified or a component of an extract, and either wild type or variant (either chemical or recombinant).

Additional description of enzyme compositions suitable for use according to the invention is disclosed for example in U.S. Pat. Nos. 7,670,549, 7,723,281, 7,670,549, 7,553,806, 7,491,362, 6,638,902, 6,624,132, 6,569,827, 6,197,739 and U.S. patent application Ser. No. 12/642,091 filed Dec. 18,2009 titled "Multiple Enzyme Cleaner for Surgical Instruments and Endoscopes," Ser. No. 11/279,654, filed Apr. 13, 2006 titled "Stable Solid Compositions of Spores, Bacteria, Fungi and/or Enzyme," Ser. No. 10/923,420, filed Aug. 20, 2004 titled "Enzyme-Based Cleaning Composition and Method of Use," Ser. No. 10/654,333, filed Sep. 2, 2003 titled "Stable Solid Enzyme Compositions and Methods Employing Them," the contents of which are incorporated by reference in its entirety. In addition, the reference "Industrial Enzymes", Scott, D., in Kirk-Othmer Encyclopedia of Chemical Technology, 3rd Edition, (editors Grayson, M. and EcKroth, D.) Vol. 9, pp. 173-224, John Wiley & Sons, New York, 1980 is incorporated herein in its entirety.

Organic Activator-Stabilizers

According to the invention, select organic compounds can both activate and stabilize enzymes for use in high temperature conditions, such as ware wash applications. According to an embodiment of the invention, the following organic activator-stabilizers can be employed: heat-deactivated or denatured enzymes and zwitterionic materials, such as amphoteric surfactants and amino acids and proteins.

Damaged or Denatured Enzyme

According to an embodiment of the invention, an organic activator-stabilizer for use in compositions of the invention may include a damaged or denatured enzyme. Without being limited to a particular theory of the invention, it is understood that variations in the ambient temperature, pH, salinity and/or other conditions negatively impact the stability of a protein. Accordingly, as a skilled artisan will appreciate, changes to the temperature, pH, salinity, etc. of an enzyme can result in the denaturation of the enzyme. Denaturation or damage to an enzyme is understood to negatively impact the three dimensional confirmation of the enzyme. As one skilled in the art will ascertain and without being limited to a particular mechanism of action, damaging an enzyme is one mechanism for obtain an organic activator-stabilizer for use in the compositions according to the invention.

It is highly unexpected that the inactivation or denaturation of an enzyme would have the effect of stabilizing and/or activating another enzyme (a non-inactivated or non-denatured enzyme) when used in combination. One theory of the invention yielding these unexpected results, is that the damaged enzyme frees calcium ions from the three dimensional structure and assists in activating the non-damaged enzyme yielding an enzyme source that is activated (or at least maintains activity) at high temperature conditions.

According to one embodiment of the invention, heat-deactivated enzymes, namely proteases, can be used as the organic activator-stabilizer according to the invention. According to a non-limiting embodiment of the invention, a protease may be treated with sufficient heat and for a sufficient period of time in order to deactivate the enzyme. Thereafter, the deactivated or denatured protease may be combined with another enzyme for purposes of acting as an activator-stabilizer. For example, an enzyme may be heat deactivated by exposing the enzyme to heat above ambient temperature and below about 170° F., preferably above about 120° F., and more preferably above about 140° F. The enzyme may be exposed to the heat for a few minutes, preferably about 5 minutes to cause the deactivation or denaturation.

As one skilled in the art will ascertain there are alternative mechanisms to deactivate a protease and other enzymes. The compositions of the invention as set forth herein are not limited in scope by the use of a particular mechanism for the deactivation of an enzyme or the particular enzyme to be deactivation for use as the organic activator-stabilizer according to the invention. However, according to a preferred embodiment of the invention, at least one protease enzyme is deactivated using heat for use as the organic activator-stabilizer according to the invention.

Zwitterionic Materials

According to an embodiment of the invention, an organic activator-stabilizer for use in compositions of the invention may include at least one zwitterionic material. Examples of suitable zwitterionic materials for use according to the invention as an organic activator-stabilizer include amphoteric surfactants, amino acids and/or proteins.

Examples of suitable amphoteric surfactants according to the invention include, for example, betaines, amine oxide, sulfbetaines and sultaines.

Examples of suitable amphoteric amino acids according to the invention include, for example, amino acids with electrically charged side chains. Although not intending to limit the invention in scope, electrically charged side chains can include, for example positive charges, such as for example, arginine, histidine and lysine; negative charges, such as for example, aspartic acid and glutamic acid; polar uncharged side chains, such as serine, threonine, asparagine and glutamine. In addition, amino acids with hydrophobic side chains are suitable amphoteric amino acids according to the invention for use as an organic activator-stabilizer.

Examples of suitable amphoteric proteins according to the invention include, for example, any protein having a free carboxylic and/or free amino group at the end of the protein that is able to react with acids and/or bases (dependent upon acidic or alkaline mediums). For example, a whey protein may be a suitable organic activator-stabilizer according to an embodiment of the invention.

According to the invention, the active level of a particular organic activator-stabilizer compound or compounds in the aqueous use solution may be modified according to the precise requirements of the cleaning application. For example, the amount of organic compounds formulated into the enzyme composition may vary. Alternatively, as one skilled in the art will appreciate, the active level of the aqueous use solution may be adjusted to a desired level through control of the wash time, water temperature at which the water source contacts the enzyme composition or the enzyme and detergent composition in order to form the aqueous use solution and the detergent selection and concentration.

According to a preferred embodiment, an aqueous use solution according to the invention may comprise, consist of and/or consist essentially of approximately 0.1 ppm and 1000 ppm organic activator-stabilizer compounds, preferably between about 0.5 ppm and about 800 ppm, and more preferably between approximately 1 ppm and 400 ppm organic activator-stabilizer compounds.

According to further embodiments of the invention, the amount of organic activator-stabilizer compounds needed to activate and stabilize enzymes to clean and remove soils from a particular cleaning application varies according to the type of cleaning application and the soils encountered in such applications. According to various embodiments of the invention, levels of organic activator-stabilizer compounds in an aqueous use solution are effective at or below approximately 0.1 ppm, 0.5 ppm or 1 ppm. According to alternative embodiments, use levels of organic activator-stabilizer compounds may be as great as 10,000 ppm, with most applications utilizing organic activator-stabilizer compounds in aqueous use solutions between approximately 1-400 ppm.

Detergents

The compositions according to the invention may be an independent entity and/or may be formulated in combination with a detergent composition. According to an embodiment of the invention, a composition may be formulated into a detergent composition in either liquid or solid formulations. In addition, compositions may be formulated into various delayed or controlled release formulations.

Detergent Compositions

According to the invention, the detergent composition may be liquids or solids, including for example molded compositions, as are appreciated by those skilled in the art. Pastes and gels can be considered types of liquid. Powders, agglomerates, pellets, tablets, and blocks can be considered types of solid. For example, detergent compositions may be provided in the form of blocks, pellets, powders (i.e., mixture of granular dry material), agglomerates and/or liquids under room temperature and atmosphere pressure conditions. Powder detergents are often prepared by mixing dry materials or by mixing a slurry and drying the slurry. Pellets and blocks are typically provided with a size that is determined by the shape or configuration of the mold or extruder through which the detergent composition is compressed. Pellets are generally characterized as having an average diameter of about 0.5 cm to about 2 cm. Blocks are generally characterized as having an average diameter of greater than about 2 cm, preferably between about 2 cm and about 2 ft., and can have an average diameter of between about 2 cm and about 1 ft. According to a preferred embodiment, a solid block is at least 50 grams.

According to certain embodiments of the invention, the detergent composition is substantially free of phosphorous. Substantially phosphorous-free refers to a composition to which phosphorous-containing compounds are not added. In an exemplary embodiment, the cleaning composition includes less than approximately 10% phosphates, phosphonates, and phosphites, or mixtures thereof by weight. Preferably, the detergent composition includes less than approximately 5% phosphates, phosphonates, and phosphites by weight. More preferably, the detergent composition includes less than approximately 1% phosphates, phosphonates, and phosphites by weight. Most preferably, the detergent composition includes less than approximately 0.1% phosphates, phosphonates, and phosphites by weight.

Additional description of detergent compositions, and methods of formation of the same, suitable for use according to the invention are disclosed, for example, in U.S. Pat. Nos. 7,674,763, 7,153,820, 7,094,746 and 6,924,257 and U.S. patent application Ser. No. 12/695,370, filed Jan. 28, 2010 titled "Method for Washing an Article using a Molded Detergent Composition," the contents of which are incorporated by reference in its entirety.

Use of detergent compositions with the aqueous use solution according to the invention can be used in conventional detergent dispensing equipment. For example, commercially available detergent dispensing equipment which can be used according to the invention are available under the name Solid System™ from Ecolab, Inc. Use of such dispensing equipment results in the erosion of a detergent composition by a water source to form the aqueous use solution according to the invention.

Additional Functional Ingredients

One skilled in the art will ascertain that additional functional ingredients may be used with the compositions according to the invention, such that the ingredients are compatible with the cleaning compositions. The term "compatible," as used herein, means the additional functional ingredients do not reduce and/or otherwise negatively impact the efficacy of the composition, including the enzymatic activity of the protease or other enzymes, to such an extent that the enzyme is not effective as desired during its intended use according to the methods of the present invention.

The compositions of the invention may also comprise, consist of and/or consist essentially of stabilizers, buffers, cofactors, inert vehicles, solvents, dyes, fragrances, anti-redeposition agents, corrosion inhibitors, defoamers, antimicrobial agents, preservatives, chelators, bleaching agents and combinations of the same.

Exemplary aesthetic additives which can be used as additional components include dyes and fragrances, such as dye #2, and a preferred fragrance includes lemon fragrance. Exemplary anti-redeposition agents which can be incorporated according to the invention include sodium carboxy methylcellulose, sodium polyacrylate, and hydroxypropyl cellulose. Exemplary corrosion inhibitors which can be incorporated according to the invention include triethanolamine, and doderylamine. Numerous additional corrosion inhibitors can be incorporated and are described, for example, in U.S. patent application Ser. No. 12/617,419, filed Nov. 12, 2009 titled "Warewashing Composition for Use in Automatic Dishwashing Machines, and Methods for Manufacturing and Using," the contents of which are incorporated by reference in its entirety. Additional anti-etch agents can be further utilized to reduce the etching or corrosion found on certain surfaces treated with detergent compositions. Examples of suitable anti-etch agents include adding metal ions to the composition such as zinc, zinc chloride, zinc gluconate, aluminum, and beryllium. However, according to certain embodiments of the invention, anti-etch agents are not required for use of the methods of the present invention.

Exemplary buffering agents which can be incorporated according to the invention include sodium acetate, potassium dihydrogen phosphate, and sodium borate. Exemplary defoamers which can be incorporated according to the invention include polymeric silicone derivatives, and alkynol derivatives. Exemplary antimicrobial agents which can be incorporated may include paraben materials such as propyl paraben. Additional antimicrobial agents which can be incorporated according to the invention include tert-amylphenol, quaternary ammonium compounds, and active halogen containing compounds. Exemplary chelators which can be incorporated according to the invention include nitrilotriacetic acid (NTA) and ethylenediaminetetraacetic acid (EDTA) to help control scale, remove soils, and/or sequester metal ions such as calcium, magnesium and iron.

Bleaching agents may also be incorporated according to the invention in order to lighten or whiten a substrate, and can include bleaching compounds capable of liberating an active halogen species, such as $Cl_2$, $Br_2$ —OCl — and/or —OBr—, or the like, under conditions typically encountered during the cleansing process. Examples of suitable bleaching agents include, but are not limited to: chlorine-containing compounds such as chlorine, a hypochlorite or chloramines. Examples of suitable halogen-releasing compounds include, but are not limited to: alkali metal dichloroisocyanurates, alkali metal hypochlorites, monochloramine, and dichloroamine. Encapsulated chlorine sources may also be used to enhance the stability of the chlorine source in the composition (see, for example, U.S. Pat. Nos. 4,618,914 and 4,830,773, the disclosures of which are incorporated by reference herein). The bleaching agent may also include an agent containing or acting as a source of active oxygen. The active oxygen compound acts to provide a source of active oxygen and may release active oxygen in aqueous solutions. An active oxygen compound can be inorganic, organic or a mixture thereof. Examples of suitable active oxygen compounds include, but are not limited to: peroxygen compounds, peroxygen compound adducts, hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine. It is to be appreciated by a skilled artisan that certain embodiments of the invention preferably use compositions that are chlorine-free to promote the use of enzymes according to the invention.

In a further embodiment of the invention, a bleach or any bleaching component is not required as part a component of the compositions and/or methods of the invention.

One skilled in the art shall ascertain additional components that may be used in combination with the methods of the present invention.

Additional Enzyme Stabilizers

The compositions for use in the methods of the present invention may further include enzyme stabilizers. One skilled in the art will ascertain suitable enzyme stabilizers and/or stabilizing systems for enzyme compositions suitable for use according to the invention, and may include those described, for example, in U.S. Pat. Nos. 7,569,532 and 6,638,902, which are incorporated herein by reference in their entirety. According to an embodiment of the invention, an additional enzyme stabilizing system may include a mixture of carbonate and/or bicarbonate and can also include other ingredients to stabilize certain enzymes or to enhance or maintain the effect of the mixture of carbonate and bicarbonate. An enzyme stabilizer may further include boron compounds or calcium salts. For example, enzyme stabilizers may be boron compounds selected from the group consisting of boronic acid, boric acid, borate, polyborate and combinations thereof.

According to an embodiment of the invention, the additional enzyme stabilizers do not include chlorine bleach scavengers for the prevention of chlorine bleach species attacking and inactivating the enzymes (e.g. alkaline conditions).

According to alternative embodiments of the invention, the enzyme compositions for use in the methods of the present invention are preferably free of additional enzyme stabilizers. According to a preferred embodiment, the enzyme compositions are free of any enzyme-stabilizing calcium and/or magnesium sources.

Composition Formulations

The enzyme (or enzymes) and organic activator-stabilizer compounds can be formulated into a variety of compositions according to the invention. All formulations disclosed herein shall be understood to optionally include the additional composition components disclosed according to the invention, including for example the detergents, any combination of additional functional ingredients and/or additional enzyme stabilizers. The description of composition formulations suitable for use in the methods of the invention shall not be limited according to the particular formulations described herein.

According to an embodiment of the invention, the compositions according to the invention may be incorporated into a solid cleaning composition. Exemplary solid cleaning composition include a solid form such as a powder, a flake, a granule, a pellet, a tablet, a lozenge, a puck, a briquette, a brick, a solid block, a unit dose, or another solid form known to those of skill in the art. The term "solid" refers to the state of the composition under the expected conditions of storage and use of the solid composition. In general, it is expected that the solid composition will remain in solid form when exposed to temperatures of up to about 100° F. and greater than about 120° F.

According to an embodiment of the invention, the compositions according to the invention may be incorporated into a solid or a liquid concentrate composition. According to an embodiment of the invention a solid or liquid concentrate can be provided in a suitable formulation to be adfixed inside a washer for multiple use applications. Formulations for multiple-use solids, such as, a block or a plurality of pellets, and can be repeatedly used to generate aqueous compositions for multiple washing cycles. In certain embodiments, the solid multi-use composition is provided as a solid having a mass of about 5 g to 10 kg. In certain embodiments, a multiple-use form of the solid composition has a mass of about 1 to 10 kg. In further embodiments, a multiple-use form of the solid composition has a mass of about 5 kg to about 8 kg. In other embodiments, a multiple-use form of the solid composition has a mass of about 5 g to about 1 kg, or about 5 g and to 500 g.

For example, a solid or liquid concentrate composition may be comprised of at least one enzyme source, at least one organic activator-stabilizer compound source (e.g. heat-deactivated enzymes) and optionally a detergent source. According to an alternative embodiment of the invention, a solid or liquid concentration composition can be provided in a formulation suitable for adfixing inside a washer or other apparatus and may be comprised of the organic activator-stabilizer compound source (e.g. heat-deactivated enzymes) and other optional functional ingredients. According to such an embodiment, the enzyme source (non-deactivated) is added during the cleaning application as further described according to the methods of use of the present invention.

In certain embodiments, a solid composition is provided in the form of a unit dose. A unit dose refers to a solid cleaning composition unit sized so that the entire unit is used during a single cleaning cycle, such as a washing cycle. When the solid composition is provided as a unit dose, it can have a mass of about 1 g to about 50 g. In other embodiments, the composition can be a solid, a pellet, or a tablet having a size of about 50 g to 250 g, of about 100 g or greater, or about 40 g to about 11,000 g.

For purposes of clarity, according to various embodiments of the invention wherein the organic activator-stabilizer compound is a pre-treated enzyme source (e.g. heat-deactivated enzymes), the compositions will have at least two distinct enzyme compositions in the formulation: a pre-treated enzyme source suitable for acting as the organic activator-stabilizer compound and a second enzyme source (non-deactivated), wherein the second enzyme source is activated and/or stabilized according to the methods of the invention as a result of the combination with the pre-treated enzyme source.

According to a further embodiment of the invention, the compositions according to the invention may be obtained commercially in a solid (i.e., puck, powder, etc.) or liquid formulation. According to an alternative embodiment of the invention the compositions can be incorporated into a detergent composition.

According to a still further alternative embodiment of the invention the compositions can be formulated and used as separate product systems. For example, an enzyme source can be separate from an organic activator-stabilizer source and combined at a point of use for a particular cleaning application as described further according to the methods of use of the present invention.

The methods of manufacture of the various compositions formulations disclosed herein are well known to a skilled artisan and such methods of manufacture are not critical to the present invention.

Packaging Systems

In some embodiments, the solid formulations can be packaged. The packaging receptacle or container may be rigid or flexible, and composed of any material suitable for containing the compositions produced according to the invention, as for example glass, metal, plastic film or sheet, cardboard, cardboard composites, paper, and the like. A mixture may be formed directly in the container or other packaging system without structurally damaging the material. As a result, a wider variety of materials may be used to manufacture the container than those used for compositions that processed and dispensed under molten conditions.

Suitable packaging used to contain the compositions is manufactured from a flexible, easy opening film material.

Methods of Use

According to an embodiment of the invention, enzyme stabilizing and activating compositions are used to provide improved cleaning through the activated use of enzymes under high temperatures providing improved detergency. Enzymes are used according to the methods of the invention to effectively remove soils from a variety of substrates. In addition, the methods of using activated and stabilized enzymes for cleaning applications at high temperatures further promotes cleaning of various surfaces, including ware and the wash equipment surfaces itself, such as the interior of a washing machine by improving the detergency of the cleaning application. The various methods of use according to the invention present a significant advantage over prior art cleaning methods having significant temperature limitations that effectively preclude the use of thermally labile enzymes, such as proteases.

Dispensing of the Compositions

The cleaning composition according to the present invention can be dispensed in any suitable method generally known. The cleaning or rinsing composition can be dispensed from a spray-type dispenser such as that disclosed in U.S. Pat. Nos. 4,826,661, 4,690,305, 4,687,121, 4,426,362 and in U.S. Pat. Nos. Re 32,763 and 32,818, the disclosures of which are herein incorporated by reference in their entirety. Briefly, a spray-type dispenser functions by impinging a water spray upon an exposed surface of the solid composition to dissolve a portion of the composition, and then immediately directing the concentrate solution including the composition out of the dispenser to a storage reservoir or directly to a point of use. When used, the product is removed from the package (e.g.) film and is inserted into the dispenser. The spray of water can be made by a nozzle in a shape that conforms to the solid shape. The dispenser enclosure can also closely fit the detergent shape in a dispensing system that prevents the introduction and dispensing of an incorrect detergent. The aqueous concentrate is generally directed to a use locus.

In an embodiment, the present composition can be dispensed by immersing either intermittently or continuously in water. The composition can then dissolve, for example, at a controlled or predetermined rate. The rate can be effective to maintain a concentration of dissolved cleaning agent that is effective for cleaning In an embodiment, the present composition can be dispensed by scraping solid from the solid composition and contacting the scrapings with water. The scrapings can be added to water to provide a concentration of dissolved cleaning agent that is effective for cleaning Methods Employing the Compositions One skilled in the art will appreciate that the methods according to the invention can be used for a variety of cleaning applications, for enhanced performance and/or reducing cleaning costs. The various cleaning applications may include for example, ware washing, instrument cleaning, manual pot and pan cleaning, presoak products, drain cleaning, food and beverage plant cleaning, housekeeping applications and the like. Additional cleaning applications according to the methods of the invention may include laundry washing and other applications. For example, laundry applications according to the invention may include the use of the compositions with detergents, presoaks, rinse and cleaners, sours, softeners and the like.

Still further, cleaning applications in health care may further benefit from the methods according to the invention, including for example, various instruments and surfaces used in health care facilities. In addition, cleaning applications in commercial restaurants, housekeeping and like may further employ methods of the present invention as one skilled in the art shall ascertain.

Beneficially, the methods of the invention allow the use of enzymes at high temperature conditions, such as for warewash temperatures and conditions. According to particular embodiment, the methods of the invention permit the use of various heat labile enzymes at temperatures above at least 150° F., preferably above at least 160° F., and more preferably above at least 160-170° F. This overcomes a significant limitation of the use of the heat labile enzymes having prior limitations of use above temperatures of approximately 60° C. (140° F.).

The enzyme (or enzymes) and organic activator-stabilizer compounds can be provided to cleaning application in a variety of formulations, including for example, solid or a liquid concentrates. The methods of the invention described herein are not limited to a particular formulation or composition according to the invention. Exemplary methods are described and one skilled in the art will ascertain that the various formulations disclosed can be used according to the various methods of use.

In some embodiments, the methods of the invention include a pretreatment step to obtain the organic activator-stabilizer compound. In the event the organic activator-stabilizer is a deactivated enzyme, the pretreatment step may include subject a source of enzymes to variations in the ambient temperature, pH, salinity and/or other conditions that are expected to negatively impact the stability of a protein. The pretreatment steps to cause denaturation or damage to the enzymes preferably include the use of heat to deactivate the enzymes, namely proteases, for use as the organic activator-stabilizer according to the invention. According to a non-limiting embodiment of the invention, the enzymes are pretreated with sufficient heat and for a sufficient period of time in order to deactivate the enzyme. For example, an enzyme may be heat deactivated by exposing the enzyme to heat above ambient temperature and below about 170° F., preferably above about 120° F., and more preferably above about 140° F. The enzyme may be exposed to the heat for a few minutes, preferably about 5 minutes to cause the deactivation or denaturation.

According to alternative embodiments of the invention, a pretreatment step is not employed with alternative organic activator-stabilizer compounds are utilized in a particular composition (i.e. non-deactivated enzymes). One skilled in the art will ascertain that the method of first deactivating an enzyme source for subsequent use and/or combination into a formulation with an additional enzyme source and optionally a detergent source provides for methods of use that significantly divert from the methods employed by those skilled in the art. It is unexpected that by first deactivating a source of enzymes (such as through the use of heat) will result in the activation and/or stabilization of a second enzyme source for enhanced use and performance in cleaning applications under high temperatures.

According to an embodiment of the invention the solid or liquid concentrate contacts a wash water source. The contacting step may include the adfixing of the composition to the inside of a washer for multiple use applications. Alternatively, the compositions can be incorporated into detergent compositions and introduced to a wash water source for a particular cleaning application as one skilled in the art would ascertain. Still further, alternative methods of contacting the compositions of the invention with a wash water source may include the introduction of the composition elements independently or in sequence. For example, the organic activator-stabilizer compounds (e.g. deactivated enzymes) may be first introduced to a cleaning process, wherein the second enzyme source is subsequently introduced. One skilled in the art will ascertain that the timing of introduction of the compositions is an important aspect of the invention. For example, it is important for the organic activator-stabilizer to be first introduced to ensure that the addition of the enzymes are activated and stabilized under the high temperature conditions.

According to another embodiment, the organic activator-stabilizer is added at least 1 minute prior to the second enzyme source. In another embodiment, the organic activator-stabilizer is added to and maintained in a sump solution of washing machine prior to the addition of the second enzyme source. One skilled in the art will ascertain additional embodiments of the application of the organic activator-stabilizer according to the invention.

The compositions may be introduced, for example, manually or by a dispenser, pump, pump and control system or other means. According to the invention, an aqueous use solution is generated by adding the compositions of the invention to a water source. According to various embodiments of the invention, an aqueous use solution may also be generated by adding the compositions of the invention to a further detergent composition. Alternatively according to the invention, a detergent composition may be formulated in combination or separately from the organic activator-stabilizer compound and enzyme composition.

The methods of using activated and stabilized enzyme compositions according to the invention include cleaning a soiled substrate, such as warewash applications. According to embodiments of the invention, enzymes reduce or eliminate soil content in a wash application or on a substrate surface. Preferred embodiments of the invention provide complete elimination of soil levels in a wash application or on a substrate surface. According to a further embodiment of the invention, methods of cleaning using activated and stabilized enzymes further result in the prevention of and removal of soil buildup on the interior surfaces of cleaning equipment and treated surfaces contained therein. Such surfaces may be either removable or permanent surfaces of cleaning equipment.

All publications and patent applications in this specification are indicative of the level of ordinary skill in the art to which this invention pertains. All publications and patent applications are herein incorporated by reference to the same extent as if each individual publication or patent application was specifically and individually indicated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Example 1

Photographic film contains a layer of a binding agent that is a protein (gelatin) which is readily attacked and removed by protease under ambient conditions. The film has multiple colored layers of the gelatin binding agent which can serve as an indication of the degree of attack if exposed to suitable enzymes. Photographic film was used in experiments to show the ability of enzymes, proteases, to attach or remove the protein layer under various conditions. In particular, the removal of the various layers of protein results in different colors remaining on the film, as set forth herein: tan indicates no attack (or change) of the protein layer by the enzyme; red indicates the protein has removed the first layer; and blue indicates that the enzyme removed the first and second layers of the protein on the photographic film. As set forth in Table 1, bolded results indicate that the enzyme removed both the first and second layers of the protein on the film, yielding a blue result on the photographic film.

In the experiments outlined in Table 1, a beaker was charged with 5 grain tap water. An activator, "Additive 1", was added to the beaker with the water temperature adjusted to the temperature as shown in the "Temp (F) Additive 1" column. The solution was then adjusted for the film test to the temperature as shown in "Temp (F) Enzyme" and a protease enzyme and section of photographic film added. The solution was stirred for 5 minutes and the film recovered and wiped with a paper towel for visual examination.

Protease enzymes used for this Example included Savinase and Esperase (tradenames available from Novozyme). The lipase enzyme used for this Example is Lipex (tradename also available from Novozyme).

The additive, enzyme and then the combination of protease enzyme and additives were heated to the temperatures indicated in the applicable columns to analyze the various conditions under which the protease enzyme was able to readily attack and removed the protein (gelatin) layers of the photographic film.

The "Additive 1" and "Temp (F) Additive 1" columns indicates (if applicable) the concentration of additive added to a beaker of water and temperature of the water at the time of addition of a particular additive to the test beaker. The solution was then heated for approximately 5 minutes to reach the temperature shown in the "Temp (F) Enzyme" column. The test enzyme and photographic film were then added to the solution in an amount sufficient to obtain the particular concentration of enzyme in the test beaker that shown in the "Enzyme" column. The concentration of test enzyme added at this point is shown under the heading "Enzyme". The temperature was held for a sufficient period of time at the temperature shown in the "Temp (F) Film Treatment" column. The strip was stirred in the solution and then removed after 5 minutes. Any strip was wiped with a paper cloth to remove any loose (e.g. digested) gelatin.

The items in bold in Table 1 demonstrated activation-stabilization of the enzyme at an unexpectedly high temperature of at least 160° F.

below the tested range of 160-170° F., which is illustrative of ware wash temperature conditions under which proteases are not expected to survive. For example, the protease Savinase is one of the most readily denatured commercially-available proteases. Savinase is known to quickly denature at temperatures in excess of 60° C. (i.e. 140° F.).

In comparison, when various protease enzymes were combined with an additive, the enzymes were able to remove the layers of protein film at the same high temperature ranges of 160-170° F. using half the concentration (400 ppm)—see Runs 2, 3, 8 and 12-15, demonstrating an embodiment of the invention wherein an enzyme in combination with an activator promotes the unexpected efficacy of the enzyme at such elevated temperatures. In particular, Runs 2, 3, 8 and 12-15 yielded enzymes that retained enzymatic ability and/or were activated to enhance enzymatic activity in order to remove the layers of protein on the photographic film at elevated temperatures. In particular, these enzymes were able to do so at temperatures of at least 160° F. Runs 2 and 14-15 yielded the most efficacious removal of protein layers from the photographic film at elevated temperatures.

The experiment demonstrates that heat-deactivated enzymes function as activators allows the subsequent enzyme to unexpectedly function and thrive at the elevated temperatures (e.g. 160° F., Run 3). Run 3 demonstrates that an initial deactivation or denaturation of enzyme (as a result of heating to temperature of 160° F.) that is cooled and combined with an active enzyme allows the functioning of the enzyme at a temperature of 65° F.

Experiment 2 shows a when the enzyme was added to a beaker of water at 65° F. As with all the experiments, the solution in the beaker was then heated (typically to 160° F.), which effectively "deactivates" the enzyme, and then second enzyme source added. Accordingly, the results demonstrate that the use of a heat-deactivated enzyme may serve as an activator for additional enzyme.

According to the results, the other additives that function to activate and/or stabilize enzymes at elevated temperatures

TABLE 1

| Run | Additive 1 | Temp (F) Additive 1 | Enzyme | Temp (F) Enzyme | Temp (F) Film Treatment |
|---|---|---|---|---|---|
| 1 | None | None | 800 ppm Savinase | 160-170 | 160-170 |
| **2** | **400 ppm Savinase** | **65** | **400 ppm Savinase** | **160-170** | **160-170** |
| **3** | **400 ppm Savinase** | **160** | **400 ppm Savinase** | **65** | **65** |
| 4 | 400 ppm Savinase | 180 | 400 ppm Savinase | 65 | 65 |
| 5 | 400 ppm Savinase | 180 | 400 ppm Savinase | 180 | 170-180 |
| 6 | None | None | 800 ppm Esperase | 160-170 | 160-170 |
| 7 | 400 ppm Esperase | 65 | 400 ppm Esperase | 160-170 | 160-170 |
| **8** | **400 ppm Savinase** | **65** | **400 ppm Esperase** | **160-170** | **160-170** |
| 9 | None | None | 800 Lipex | 160-170 | 160-170 |
| 10 | 400 ppm Savinase | — | 800 Lipex | — | — |
| 11 | 400 ppm Gelatin | 65 | 400 ppm Savinase | 160-170 | 160-170 |
| **12** | **400 ppm Proline** | **65** | **400 ppm Savinase** | **160-170** | **160-170** |
| **13** | **400 ppm Whey** | **65** | **400 ppm Savinase** | **160-170** | **160-170** |
| **14** | **400 ppm CAPB** | **65** | **400 ppm Savinase** | **160-170** | **160-170** |
| **15** | **400 ppm CAPB** | **65** | **400 ppm Esperase** | **160-170** | **160-170** |
| 16 | 400 ppm CAPB | 180 | 400 ppm Savinase | 180 | 170-180 |
| 17 | 400 ppm $NaHCO_3$ | 65 | 400 ppm Savinase | 160-170 | 160-170 |

Results

As shown in Table 1, control Runs 1, 6 and 9 were completed using only the protease enzymes (i.e. Savinase 800 ppm, Esperase 800 ppm, Lipex 800 ppm, respectively) in solution. Each of the proteases were unable to remove any layers of the protein from the film at the elevated temperatures of 160-170° F. This is consistent with the understanding and current use of enzymes being limited to temperatures well (160-170° F.) include proline (amino acid), whey (protein) and cocoamidyl propyl betaine (CAPB) (zwitterionic surfactant). These additives are 25 illustrative of amino acids, proteins and zwitterionic surfactants, respectively, which are suitable for use as enzyme activators/stabilizers according to the invention.

The inventions being thus described, it will be obvious that the same may be varied in many ways. Such variations are not to be regarded as a departure from the spirit and scope of the inventions and all such modifications are intended to be included within the scope of the following claims.

What is claimed:

1. A method of cleaning a hard surface comprising:

contacting the hard surface with an aqueous composition comprising from about 1 ppm to about 800 ppm protease enzyme, and about 400 ppm organic activator-stabilizers, wherein said organic activator-stabilizers increase stabilization of said enzyme at temperatures in excess of at least 160° F. up to temperatures of 180° F.; and wherein said organic activator-stabilizers are selected from the group consisting of amphoteric amino acids consisting of proline, amphoteric proteins consisting of whey, and combinations of the same; and wherein the composition is free of additional enzyme stabilizers.

2. The method of claim 1, wherein said protease in said aqueous composition is between about 1 ppm and about 400 ppm.

3. The method of claim 1, wherein said contacting step comprises either adfixing a multi-use solid concentrated composition capable of forming said aqueous composition to the inside of a cleaning application and contacting a water source, or adding a single use concentrated liquid or solid composition capable of forming said aqueous composition to a water source to form said aqueous composition.

4. A method of cleaning a hard surface comprising:

(a) contacting the hard surface with sufficient organic activator-stabilizer to form an aqueous composition of about 400 ppm organic activator-stabilizer, wherein said organic activator stabilizer is selected from the group consisting of amphoteric amino acids consisting of proline, amphoteric proteins consisting of whey, and combinations of the same; and (b) contacting the hard surface with sufficient enzyme to generate from about 0.1 ppm to about 400 ppm protease enzyme in said aqueous composition, and wherein the composition is free of additional enzyme stabilizers, and wherein said organic activator-stabilizer increases stabilization of said enzyme at temperatures in excess of at least 160° F. up to temperatures of 180° F.

5. The method of claim 4, wherein said aqueous composition further comprises a detergent composition.

6. The method of claim 4, wherein said hard surface is selected from the group consisting of textiles, ware, health care instruments and combinations of the same.

7. The method of claim 4, wherein said aqueous composition comprises between about 1 ppm and about 400 ppm protease enzyme.

8. An enzyme stabilizing and activating aqueous composition for performance at elevated temperatures comprising:

(a) an aqueous composition;

(b) from about 1 ppm to about 800 ppm protease enzyme; and (c) about 400 ppm organic activator-stabilizers selected from the group consisting of amphoteric amino acids consisting of proline, amphoteric proteins consisting of whey, and combinations of the same, and wherein said organic activator-stabilizers increase stabilization of said enzyme at temperatures in excess of at least 160° F. up to temperatures of 180° F.; and wherein the composition is free of additional enzyme stabilizers.

9. The composition of claim 8, wherein said organic activator-stabilizer is amphoteric proteins consisting of whey.

10. The composition of claim 8, wherein the protease in said aqueous composition is between about 1 ppm and about 400 ppm.

11. The composition of claim 8 further comprising a detergent.

* * * * *